United States Patent [19]

Sadow

[11] Patent Number: 4,781,278

[45] Date of Patent: Nov. 1, 1988

[54] SIMULATED HARD FRAME LUGGAGE

[76] Inventor: Brian D. Sadow, 21 Pondhill Rd., Chappaqua, N.Y. 10514

[21] Appl. No.: 124,662

[22] Filed: Nov. 24, 1987

[51] Int. Cl.[4] ..... A45C 7/00

[52] U.S. Cl. ..... 190/107; 190/127

[58] Field of Search ..... 190/107, 108, 110, 122, 190/124, 126, 127

[56] References Cited

U.S. PATENT DOCUMENTS

| | | | |
|---|---|---|---|
| 1,999,424 | 4/1935 | Seitz | 190/126 X |
| 3,061,057 | 10/1962 | Miller | 190/110 |
| 3,447,649 | 6/1969 | Kish, Jr. | 190/127 X |
| 3,592,314 | 7/1971 | Jacobson | 190/122 X |
| 3,977,501 | 8/1976 | Alonso | 190/127 |
| 4,176,734 | 12/1979 | Wang | 190/127 X |
| 4,210,230 | 7/1980 | Weiner | 190/127 X |
| 4,418,804 | 12/1983 | Bradley et al. | 190/127 X |
| 4,598,802 | 7/1986 | Abenaim | 190/107 |
| 4,655,329 | 4/1987 | Kaneko | 190/107 |

*Primary Examiner*—William Price

*Attorney, Agent, or Firm*—Abelman Frayne Rezac & Schwab

[57] ABSTRACT

An article of soft luggage is formable into a simulation of an article of hard luggage by the provision of axially extending stiffening members and collapsible interconnecting members arranged at the corners thereof, the article of soft luggage having a peripheral stiffening frame whereby dimensional stability of the article of soft luggage is provided in all directions along the outer surface thereof.

8 Claims, 3 Drawing Sheets

SIMULATED HARD FRAME LUGGAGE

FIELD OF THE INVENTION

This invention relates to carrying cases for articles of luggage of the type commonly known as soft luggage, and which are comprised of one or more center sections of a flexible fabric material, and end sections of a flexible fabric material that are attachable to the center sections to provide a complete carrying case in the form of a suitcase.

BACKGROUND OF THE INVENTION

Soft luggage articles are well-known in the art. Typically, such articles of luggage are comprised of a center section of a flexible fabric material in the form of a hollow open-ended cylinder. First sections of a slide fastener are attached to the respective opposite axial ends of the hollow cylinder for the purpose of the attachment of end panels. The center section optionally is provided with a transverse floor panel for it to be in the form of a soft traylike construction, and also so that it can be filled with clothing prior to attaching end closure panels thereto. The end closure panels are attached to the center section or to an extension of the center section by means of a second section of the slide fastener, the second section of the slide fastener being attached to the periphery of the end panel for it to mesh with a first section of the slide fastener attached to the axial end of the hollow tubular center section. Italian UM number 15178 issued Apr. 2, 1984 is illustrative of typical such constructions.

However, the carrying case so assembled is of soft and flexible construction, and is prone to ugly bulging, particularly if overfilled, and, in the alternative is prone to collapse in an unsightly heap if it is underfilled.

SUMMARY OF THE INVENTION

It is an object of this invention to provide an article of soft luggage of reduced weight as compared with that of a hard luggage case, and which will retain a neat appearance without regard to whether it is overfilled or underfilled, and which closely simulates the appearance of an article of hard luggage, while at the same time preserving its ability to be collapsed into a substantially planar form for storage.

According to the present invention, the article of soft luggage is comprised of at least two sections, typically, a tray-like center section in the form of a hollow cylinder, and at least one end closure panel therefor, each of which is formed from a relatively soft and flexible fabric material. The center section and the end closure panel are each provided with a substantially rigid rectangular planar frame formed from a continuous length of rigid relatively small diameter rod. Preferably, the frame is formed from steel rod of an appropriate stiffness in relation to its diameter, and, the diameter of the rod is as small as is practicable. Alternatively, any other suitable material such as aluminum alloy or resin bonded glass fibers, rattan or bamboo can be employed as the frame.

The frame incorporated into the respective sections acts as a stretcher for the associated section, and stabilizes that section positionally in the plane of the frame.

While the frames provide stabilization in planes transverse to the axis of the hollow cylinder, they will not provide positional stability to the cylindrical center section itself. Instead, the center section itself will remain soft and floppy and positionally unstable.

In order to overcome this problem, the tubular sections are each provided with axially extending reinforcing members arranged spaced from the four corners thereof and positioned on opposite sides of the four corners thereof. The respective axially extending reinforcing members are interconnected with the adjacent axially extending reinforcing member at a corner of the tubular section, the respective pairs of axially extending reinforcing members being interconnected by a relatively stiff but flexible interconnecting member that extends substantially throughout the axial width of the tubular section at the corners thereof, or completely throughout the axial width of the tubular section at the corners thereof.

The reinforcing members and the interconnecting members can be positioned interiorly of the associated tubular member, or, they can be positioned exteriorly thereof and present a decorative and abrasion resistant covering at the corners of the tubular section.

Thus, in an assembled condition of the case, the rectangular planar frames stabilize the end panels in planar form, and in so doing stabilize the opposite axial ends of the tubular section. Stabilization of the tubular center section in the axial direction is provided by the axially extending reinforcing members, which act to hold the end panels in fixed spaced relationship. The stiff but flexible interconnecting members form and shape the radiused corners of the case, and act to stiffen the case at the corners, thus simulating the appearance of a hard frame case.

If, however, it is desired to collapse the case into planar form for storage, this readily can be done by removing the end closure panel, which itself is planar and substantially flat, and by then folding the axially extending reinforcing members inwardly of the tray-like portion comprised by the other end panel and the tubular axially extending section and into overlying relation with each other, the flexible interconnecting members permitting this folding movement.

Thus, a major advantage is secured of providing an article of soft luggage that closely simulates the appearance and neatness of an article of luggage having a hard frame, while at the same time retaining the major advantage of the ability to collapse the article of luggage into substantially planar form for storage.

DESCRIPTION OF THE ACCOMPANYING DRAWINGS

The invention will now be described with reference to the accompanying drawings, which are illustrative of preferred embodiments of the invention, and, in which FIG. 1 is an illustration of a prior art construction of soft luggage comprised of center sections and end panels;

DESCRIPTION OF THE PRIOR ART EMBODIMENT

Figure 1:
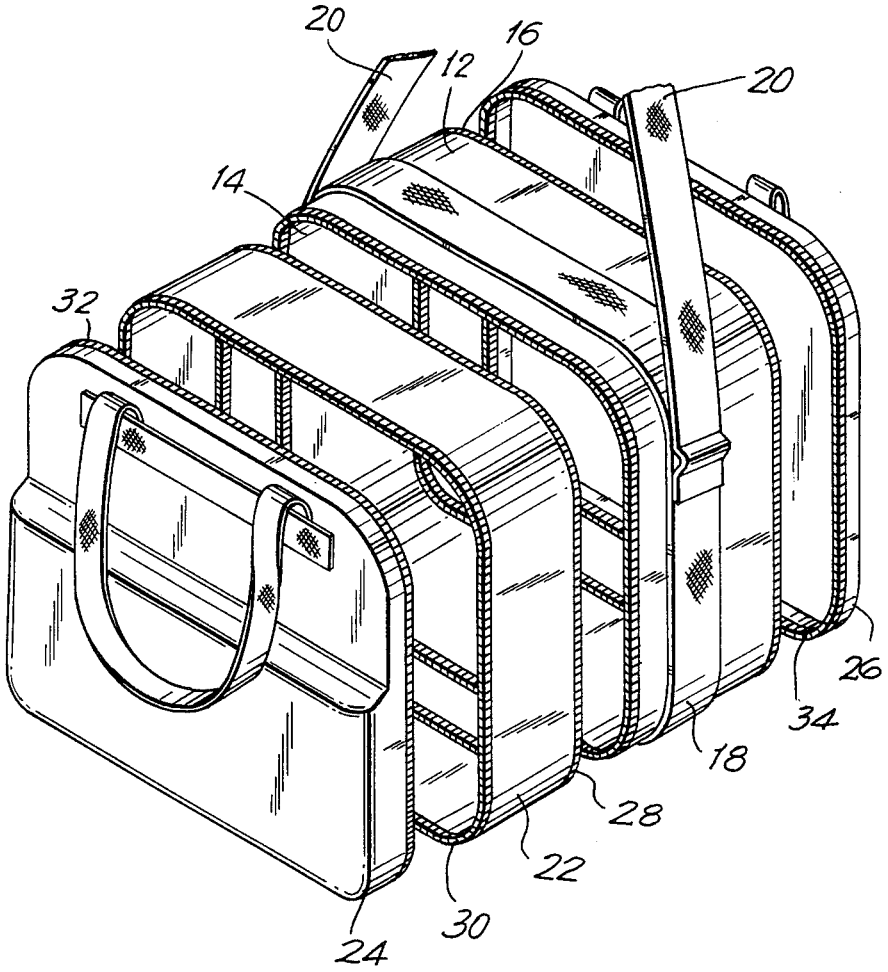
FIG. 1 PRIOR ART
Figure 2:
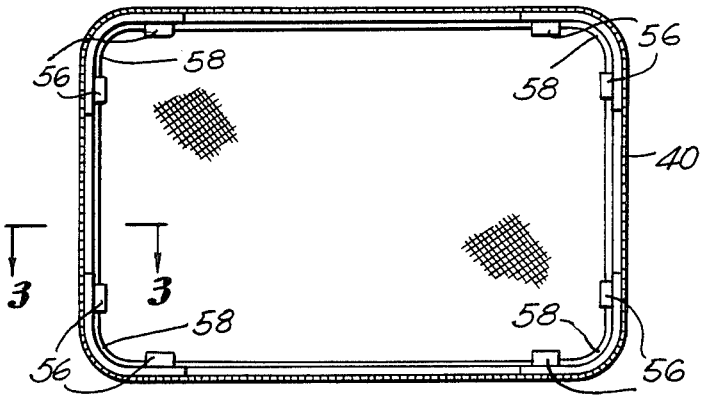
FIG. 2 is an illustration of a center section according to the present invention.
Figure 4:
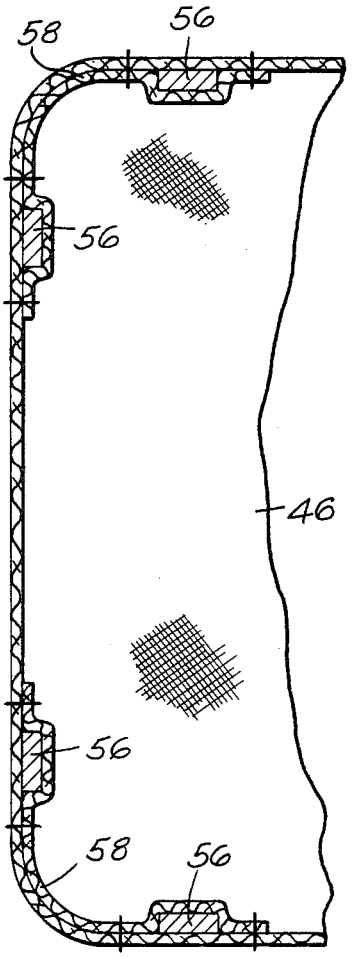
FIG. 4 is a diagrammatic illustration of an end portion of the center section of FIG. 2.
Figure 3:
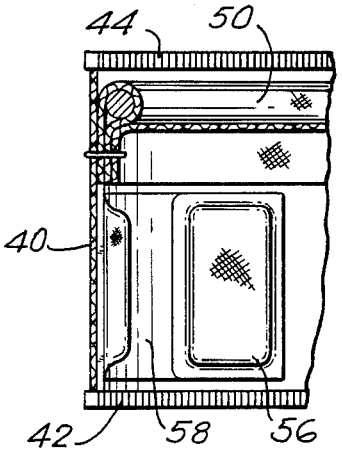
FIG. 3 is a partial transverse cross-section taken on the line 3—3 of FIG. 2.

Referring firstly to FIG. 1, a typical prior art construction of soft luggage is comprised of a center section 12 of soft and flexible fabric in the form of a hollow cylinder, the center section 12 being provided with one section of a slide fastener 14, 16 attached to its respective axial ends.

Optionally, the center section can be provided with a peripheral reinforcement 18, to which a carrying strap 20 can be attached in any convenient manner.

The center section 12 with its attached sections of slide fasteners 14, 16 is adapted to receive any one of a variety of soft luggage components 22, 24, 26, the soft luggage component 22 providing an extension of the center section 12, and similarly being provided with half sections of slide fastener elements 28, 30, the section of the slide fastener element 28 being for cooperation with the section of slide fastener element 14, the opposite section of slide fastener element 30 being for cooperation with a section of slide fastener element 32 fast with the soft luggage component 24, which in this case comprises an end closure for the article of luggage, which is securable either to the center section 12, or, in the event that the extension 22 is employed, to the extension 22.

The opposite soft luggage component 26 also provides an end closure, and is provided with a section of slide fastener element 34 for cooperation with the section of slide fastener element 16 attached to the center section 12.

By this construction, any one of a variety of articles of luggage can be assembled from separate components, depending on the required capacity of the article of luggage, this ranging from a suit-case like formation comprised of the center section 12 and a pair of end panels 24 or 26, or, it can be increased in capacity by the addition of one or more extensions such as the extension 22.

The resulting article of luggage is, however, of soft and floppy construction, and, one which is unable to retain its intended shape and configuration unless it is completely filled.

Over-filling of the article of luggage will, however, result in outward bulging of the sides, particularly the sides of the center section 12 and the extension 22. This gives rise to an unattractive, unsightly and disheveled appearance of the article of luggage. The present invention has for its particular object to eliminate that disadvantage.

DESCRIPTION OF THE PREFERRED EMBODIMENTS

Referring now to FIGS. 2 through 5, a center section 40 is illustrated, the center section being in the form of a hollow rectangular cylinder which is provided at its opposite ends with a section of slide fastener element 42, 44. While the center section 40 can be completely opened between its ends, preferably, and as more clearly illustrated in FIG. 5, one axial end of the center section 40 is closed by a panel 46. The center section 40 and the end panel 46 each can be formed from a soft and flexible fabric material, i.e., a material of insufficient rigidity for it to be itself self-supporting.

Extending peripherally of the panel 46 is a stiffening element in the form of a wire rod 48. The wire rod 48 extends completely around the periphery of the panel 46, and, is attached to the panel 46 in any convenient manner, such as by being held captive within a binding tape 50 which is machined to or otherwise secured to the periphery of the panel 46.

As illustrated, the panel 46 is itself directly attached to the center section 40 by stitching 52, the stitching extending through the perimeter of the panel 46, through the binding tape 50 and through the center section 40 such that the center section 40, the wire reinforcing rod 48 and the panel 46 comprise a unitary sub-assembly in the form of a tray-like structure. As will readily be appreciated, in the alternative, the wire reinforcing rod 48 with its binding tape 50 can be secured directly to the periphery of the panel 46, and, the periphery of the panel 46 be provided with a slide fastener element complimentary to the slide fastener elements 42 or 44 in the manner previously discussed with respect to the prior art construction. Such a modified end panel will be employed as a closure for the opposite end of the center section or of any extension attached thereto, the closure panel or extension being provided with a slide fastener element for cooperation with the slide fastener element 42. Additionally, each extensions and the associated end closure panel can be provided with a wire rod stiffening element, such as the wire rod 48.

While steel wire is preferred as the material for the wire rod 48, it will be appreciated that any other suitable material can be employed, such as a wire of high-strength aluminum alloy, a rod of fiberglass, or a rod of rattan or bamboo or the like.

Figure 5:
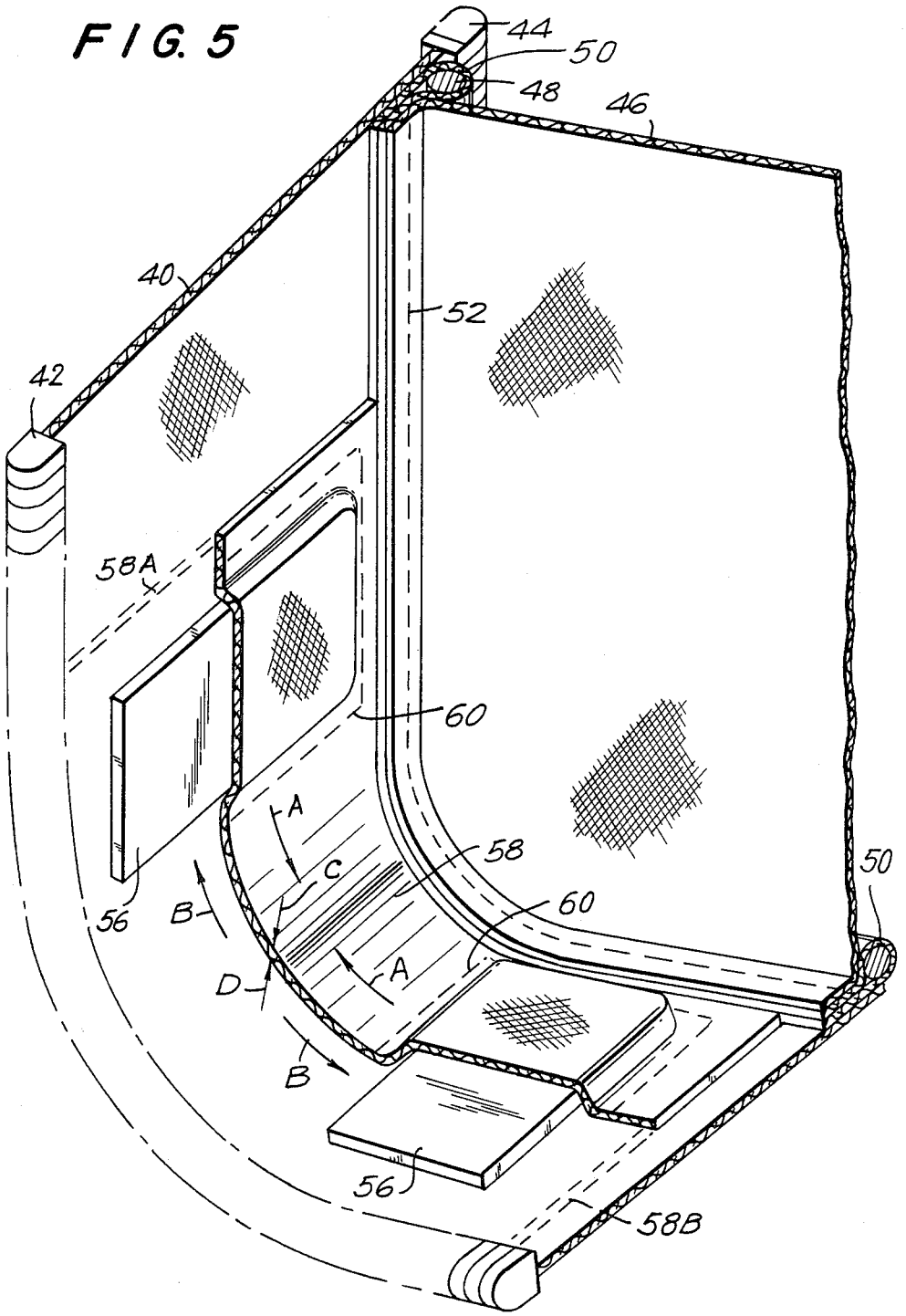
FIG. 5 is a fragmentary perspective view of the lower left hand corner of the center section of FIG. 2, and is shown partially in cross-section for clarity of illustration.

As will be further appreciated, two center sections of the type illustrated in FIG. 5 can be attached one to the other, either in series relationship, or, in back-to-back relationship.

The provision of the wire stiffening rod 48 in the respective sections of the article of soft luggage will provide for stabilization of the associated sections in the plane of the wire rod, and, will prevent collapse of that section in the plane of the wire rod and hold that section in a stretched condition, at least in the vicinity of the wire rod.

While this gives rise to dimensional form and stability to the center section 40 and to extensions thereof in the planes of the wire rods 48, it will in no way affect the stability of the center section 40 at positions intermediate the planes of the wire rods 48, i.e., the center section 40 would be capable of collapsing and deforming downwardly or laterally relative to the wire rod 48.

The present invention overcomes this problem by providing stiffening members at each corner of the center section 40, and which in their erected position provide for stabilization of the center section 40 in the direction of the axis therof. The stiffening members 56 are comprised of elongate bars, which preferably are rectangular, and which are positioned in spaced relationship at opposite ends of the curvature of each corner of the center section 40. The stiffening members preferably are plates of steel, but optionally could be plates formed from any other stiff material such as plastics, fiberglass and the like which is relatively inflexible and capable of returning to its initial planar condition if stressed out of the planar condition.

The respective stiffening members 56 at each corner of the center section 40 are held immoveable positioned within an interconneccting member 58 which is attached to the center section 40 peripherally of the stiffening members 56, and, which extends arcuately between the associated pair of stiffening members 56 without attachment to the center section 40.

The interconnecting member is formed from a relatively stiff but compliant material, and one which is capable of resuming its former shape in the event that it has been distorted out of its initial planar condition. Typical materials suitable for forming the interconnecting members are leather, a relatively heavy guage of a flexible plastics material, or a rubberized multiple-ply fabric and the like which is capable of assuming the form of a segment of a cylinder when in an erected condition, and which, is capable of being collapsed out of the form of a segment of a cylinder when it is desired to store the center section.

Preferably, the interconnecting members 58 at the respective corners of the center section 40 extend completely throughout the axial width of the center section 40, or, as far as is possible throughout the axial width of the center section.

While the interconnecting members 58 are attached to the center section 40 peripherally of the stiffening members 56, they are otherwise completely unattached to the center section 40. This gives rise to an extremely beneficial circumstance which will now be described.

By assembling the interconnecting members 58 to the center section 40 with the center section 40 and the interconecting members 58 in planar condition, (i.e., prior to the attachment of the center section 40 to the end panel 46 and its associated binding tape 50) it is ensured that the length of the center section 40 and the length of the interconnecting member 58 intermediate the associated pair of stiffening members is identical one with the other. If now the corner is bowed into the condition illustrated in the drawings, then, forces will be set up between the interconnecting member 58 and the center section 40 which will act to form a stretched and stiffened corner of the center section 40 closely simulating a corner of an article of luggage having a hard frame.

The manner in which this occurs is more clearly illustrated in FIG. 5.

In bending the center section 40 and the assembled interconnecting member 58 from the planar condition to the illustrated curved condition, compressive forces will be set up in the inwardly presented surface of the interconnecting member 58 as indicated by the arrows A, and corresponding tensile stresses will be set up in the opposite surface in the direction of the arrows B. Thus, the inner surface will attempt to decrease in length and the outer surface will attempt to increase in length, the proclivity being for the outer surface to increase in length more than the inner surface will decrease in length. This increase in the length of the outer surface will result in a lengthening of the distance between lines of stitching 60, and, in turn, will result in tensioning of the fabric of the center section 40 between the adjacent lines of stitching 60.

Thus, the center section 40 is stretched at its corners over the outer surface of the respective interconnecting members 58, the respective interconnecting members 58 at that time having been stressed into a segment of a hollow cylinder, and thus, having been rigidized to the greatest possible extent, the result being that the interconnecting members 58 exert an outward compressive force in the direction of the arrow C, while at the same time the tensioned center section 40 exerts a corresponding inwardly acting restraining force in the direction of the arrow D.

This combination of compressive, tensional and restraining forces results in the rigidifying of the corners of the center section 40 to quite a surprising extent closely simulating curved corners of an article of hard frame luggage.

It will be appreciated that in FIG. 5 the interconnecting member 58 has been shown in cross-section for clarity of illustration, and in order that the stiffening members 56 be visible. It will, however, be understood that the interconnecting member 58 extends completely across the inner surface of the center section 40 at that corner, as is indicated by the dotted lines 58A and 58B at the opposite ends of the stiffening member 58.

Further, it will be understood that identical stiffening members 56 and interconnecting members 58 can be provided at each of the four corners of an extension section to be attached to the center section, either in combination with the wire stiffening rod 48, and optionally in the presence of an end panel 46.

While the stiffening members 56 and the interconnecting members 58 have been shown and described as positioned interiorly of the corners of the center section 40, it will be appreciated that they could, if desired, be positioned exteriorly of those corners. So doing would negate the capability of the interconnecting members to stretch the corners. However, the corners would still assume a neat and trim appearance by virtue of the stiffness of the interconnecting members and their ability to form a segment of a cylinder.

Further, alternative methods of attaching the interconnecting members 58 to the center section 40 are contemplated other than mechanical stitching. For example, suitable adhesives can be employed at those locations, or, the interconnecting members 58 and the center section 40 can be sonically welded or riveted at those locations if formed of suitable materials, all of which alternatives fall within the scope of the appended claims.

I claim:

1. An article of soft luggage simulating an article of hard luggage, and comprising:

at least one center section of soft luggage formed from a flexible and compliant material, and formable into a hollow rectangular cylinder having radiused corners;

stiffening members arranged in spaced relationship and respectively positioned at opposite ends of each said radiused corner and extending substantially axially of said hollow cylinder;

an interconnecting member extending axially of said center section at said radiused corner, said interconnecting member being formed from a stiff but compliant material and being conformable to said radiused corner; and, means securing said center section and said stiffening members and adjacent portions of said interconnecting member to each other in relative immoveable relationship solely in the vicinity of said stiffening members;

whereby said interconnecting member is erectable to provide a stiffener for said corner, and is collapsible to permit flattening of said center section for storage.

2. The article according to claim 1, in which said interconnecting member extends over said stiffening members and is secured directly to said center section in the vicinity of said stiffening members and peripherally of said stiffening members to immobilize said stiffening members within said interconnecting member.

3. The article according to claim 1, in which said stiffening members and said interconnecting member are located internally of said corner, and the length of the outer surface of said interconnecting member, when conformed to said corner, is greater than that length of said center section at said corner which extends between said stiffening members, whereby said corner of said center section is held under tension by said interconnecting member, and said interconnecting member is held under compression by said center section.

4. The article according to claim 1, in which said center section is provided with a slide fastener element at an axial end thereof for the attachment of another section of soft luggage to said one axial end of said center section.

5. The article according to claim 4, in which said center section and said another section are each provided with a peripheral stiffening reinforcement serving to support each said center section and said another section in the form of a rectangular member having radiused corners.

6. The article according to claim 1, in which said center section is provided with a slide fastener element at each axial end thereof for the attachment of other sections of soft luggage to opposite axial ends of said center section.

7. The article according to claim 1, in which said center section is provided with a peripheral stiffening reinforcement adjacent one axial end thereof.

8. The article according to claim 7, in which said one axial end of said center section is provided with an end closure panel, said stiffener serving to hold said end closure panel under tension.

* * * * *